US008469868B2

(12) United States Patent
Zhang et al.

(10) Patent No.: US 8,469,868 B2
(45) Date of Patent: Jun. 25, 2013

(54) METHOD AND SYSTEM FOR BLEED CONTROL ON PACKAGING LAYOUT

(75) Inventors: Qin Zhang, Beijing (CN); Kaiming Xu, Beijing (CN); Jianjun Jiang, Beijing (CN); Hanguang Yuan, Beijing (CN)

(73) Assignee: Founder International Co., Ltd. (Beijing), Beijing (CN)

( * ) Notice: Subject to any disclaimer, the term of this patent is extended or adjusted under 35 U.S.C. 154(b) by 447 days.

(21) Appl. No.: 12/900,369

(22) Filed: Oct. 7, 2010

(65) Prior Publication Data

US 2011/0028292 A1 Feb. 3, 2011

Related U.S. Application Data

(63) Continuation of application No. PCT/CN2008/002076, filed on Dec. 25, 2008.

(30) Foreign Application Priority Data

Apr. 11, 2008 (CN) ..... 2008 1 0103820

(51) Int. Cl.
*B31B 1/88* (2006.01)

(52) U.S. Cl.
USPC ..... 493/53; 493/7; 493/187; 493/320; 493/11; 101/483; 101/484

(58) Field of Classification Search
USPC ..... 493/3, 7, 11, 187, 320; 101/483, 101/484
See application file for complete search history.

(56) References Cited

U.S. PATENT DOCUMENTS

| | | | | |
|---|---|---|---|---|
| 5,078,666 | A * | 1/1992 | Porret et al. | 493/1 |
| 5,484,102 | A * | 1/1996 | DeMay | 229/132 |
| 5,993,367 | A * | 11/1999 | Hattori et al. | 493/12 |
| 6,522,386 | B1 * | 2/2003 | Nishi | 355/52 |
| 7,182,007 | B2 * | 2/2007 | Berge et al. | 83/13 |
| 7,326,168 | B2 * | 2/2008 | Kocherga et al. | 493/463 |
| 8,240,808 | B2 * | 8/2012 | Sasayama | 347/30 |

* cited by examiner

*Primary Examiner* — Christopher Harmon
(74) *Attorney, Agent, or Firm* — Lathrop & Gage LLP

(57) ABSTRACT

Methods and systems are provided for bleed control in a packaging layout having a plurality of packaging decoration patterns for making a plurality of packaging boxes. The method includes obtaining bleed lines based on a bleed width from cutting lines of each packaging decoration pattern for each packaging box. The method also includes irradiating light beams toward the packaging layout in four directions substantially perpendicular to each side of the packaging layout to form irradiated bleed line segments. The method further includes calculating a ratio of the projection length of each of irradiated bleed line segments to a respective projection length of a respective bleed line for each packaging decoration pattern in a respective irradiating direction. The method also includes excluding the irradiated bleed line segments for releasing bleed limit if the ratio is less than the threshold, and otherwise releasing bleed limit for the irradiated bleed line facing the four directions.

12 Claims, 7 Drawing Sheets

METHOD AND SYSTEM FOR BLEED CONTROL ON PACKAGING LAYOUT

REFERENCES TO RELATED APPLICATIONS

This application is a continuation of International Patent Application No. PCT/CN2008/002076, entitled "A Method and a System for Limiting Bleed in Packaging Layouts" with an international filing date of Dec. 25, 2008, which claims priority to Chinese Patent Application No. 200810103820.8 filed Apr. 11, 2008. The contents of both applications are herein incorporated by reference into the instant disclosure.

BACKGROUND OF THE INVENTION

This disclosure relates to the technology field of packaging and printing, particularly, to a method and system for bleed control on packaging layout.

Fabrication of a package box typically requires information on a box structure pattern and a decoration pattern or artwork. The decoration pattern may be larger than the box structure pattern. A packaging layout may include a number of box structure patterns and a number of decoration patterns. External bleed lines are defined by extending outward a certain width referred to bleed width from cutting lines of each box structure pattern. If the box structure pattern has an open window or a hollow portion that are formed inside cutting lines, internal bleed lines are defined by shrinking a bleed width inward from the cutting lines that form the window. A package box may be fabricated by cutting the decoration pattern according to the bleed lines and then printing, followed by cutting the printed decoration pattern based on the cutting lines after printing. In this case, if the decoration pattern contains printing markers outside the bleed lines, these printing marks would be cut.

In current technologies, the bleed limit of all decoration patterns on the packaging layout is released. A middle division line cutting method is used to separate adjacent decoration patterns according to the outer cutting lines to prevent the decoration patterns from interfering with each other. In this way, the original printing markers of the decoration patterns may not appear on the packaging layout. Although some original printing marks may be left behind, such marks are not necessary and waste printing ink. In addition, the printing marks may cause chaos in the packaging layout and may cause interference among adjacent decoration patterns.

BRIEF SUMMARY OF THE INVENTION

This disclosure advances the art and overcomes the problems outlined above by providing a method and a system for bleed control on packaging layout in the face of existing technical problem.

In one embodiment, a method for bleed control is provided for a packaging layout having a plurality of packaging decoration patterns for making a plurality of packaging boxes. The method includes setting a bleed width and obtaining bleed lines based on the bleed width from cutting lines of each packaging decoration pattern for each packaging box. The method also includes irradiating light beams toward the packaging layout in four directions substantially perpendicular to each side of the packaging layout to form irradiated bleed line segments. The packaging layout is substantially rectangular-shaped. The method further includes calculating a ratio of the projection length of each of irradiated bleed line segments to a respective projection length of a respective bleed line for each packaging decoration pattern in a respective irradiating direction. The method also includes comparing the ratio with a threshold and excluding the irradiated bleed line segments for releasing bleed limit if the ratio is less than the threshold. The method also includes releasing bleed limit for the irradiated bleed line segments facing the four directions if the ratio is equal or greater than the threshold.

In another embodiment, a system for bleed control on packaging layout is provided. The system includes a first acquiring module configured to set a bleed width and obtain bleed lines based on the bleed width from cutting lines of each packaging decoration pattern for each packaging box. The system also includes a second acquiring module configured to irradiate light beams toward the packaging layout in four directions substantially perpendicular to each side of the packaging layout to form irradiated bleed line segments. The packaging layout is substantially rectangular-shaped. The system further includes an excluding module configured to calculate a ratio of the projection length of each irradiated bleed line segment to a respective projection length of a respective bleed line for each packaging decoration pattern in a respective irradiating direction. The excluding module is also configured to compare the ratio with a threshold and to exclude the irradiated bleed line segments for releasing bleed limit if the ratio is less than the threshold. The system also includes a releasing module configured to release bleed limit for the irradiated bleed line segments facing the four directions if the ratio is equal or greater than the threshold.

One of the benefits of the disclosed method and system is to retain outside or external printing marks such that there is no need for re-adding printing marks, in the process of packaging decoration patterns layouts. The disclosed method varies bleed control for different cases. In one case, bleed limit is released at the edge of a decoration pattern when outside printing marks need to be retained. In another case, bleed limit is not released or retained at the edge of the decoration pattern when inside printing marks are not necessary. This method enables original printing marks to be retained. The method also saves time, avoids layout confusion, and reduces consumption of printing ink.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings.

DETAILED DESCRIPTION

Figure 1:
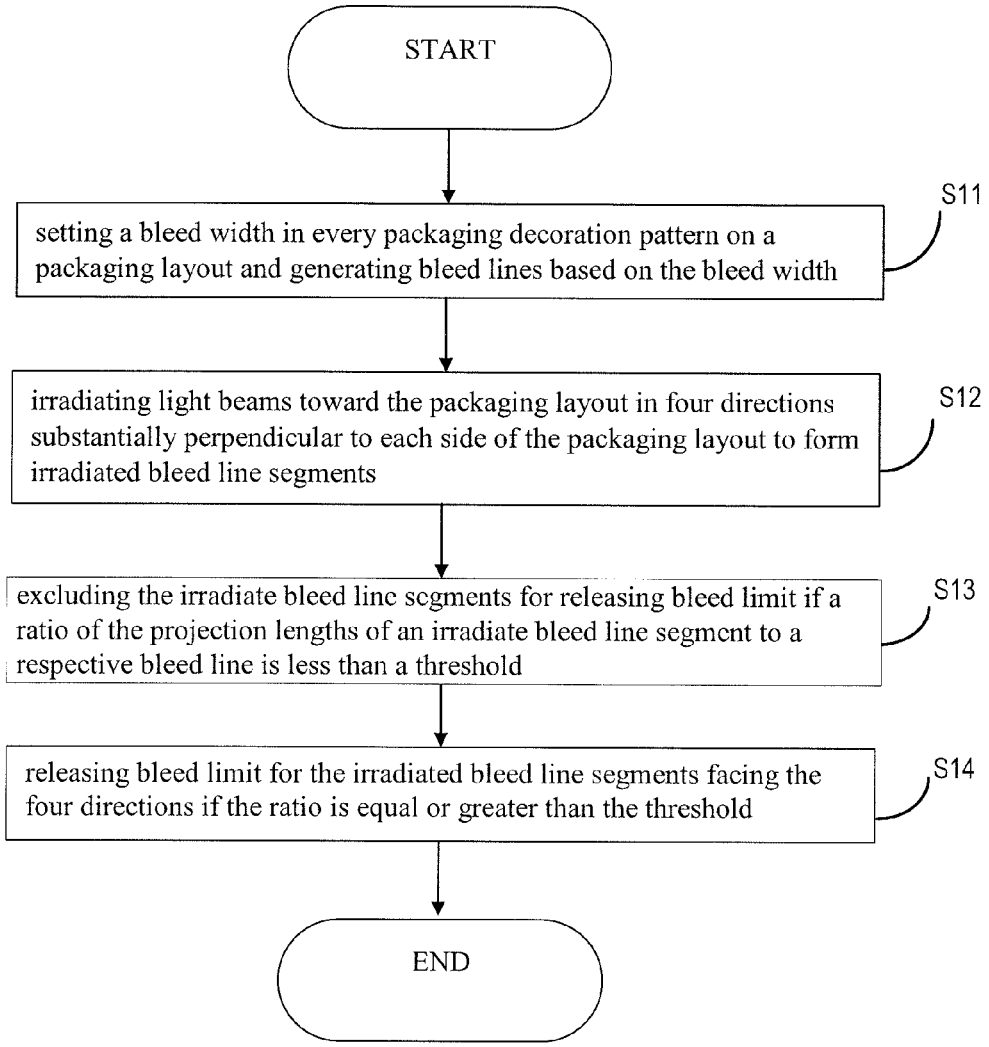
FIG. 1 is a flow chart illustrating steps for bleed control in a packaging layout in an embodiment.

The present disclosure may be understood by reference to the following detailed description taken in conjunction with the drawings as briefly described below. It is noted that, for purposes of illustrative clarity, certain elements in the drawings may not be drawn to scale.

A system for bleed control on a packaging layout is provided. The systems includes the following modules: (1) a first acquiring module configured to set a bleed width and obtain bleed lines based on the bleed width from cutting lines of each packaging decoration pattern for each packaging box; (2) a second acquiring module configured to irradiate light beams toward the packaging layout in four directions substantially perpendicular to each side of the packaging layout to form irradiated bleed line segments, wherein the packaging layout is substantially rectangular-shaped; (3) an excluding module configured to calculate a ratio of the projection length of each irradiated bleed line segment to a respective projection length of a respective bleed line for each packaging decoration pattern in a respective irradiating direction, to compare the ratio with a threshold, and to exclude the irradiated bleed line segment for releasing bleed limit if the ratio is less than the threshold; and (4) a releasing module configured to release bleed limit for the irradiated bleed line segment facing the four directions if the ratio is equal or greater than the threshold.

Figure 2:
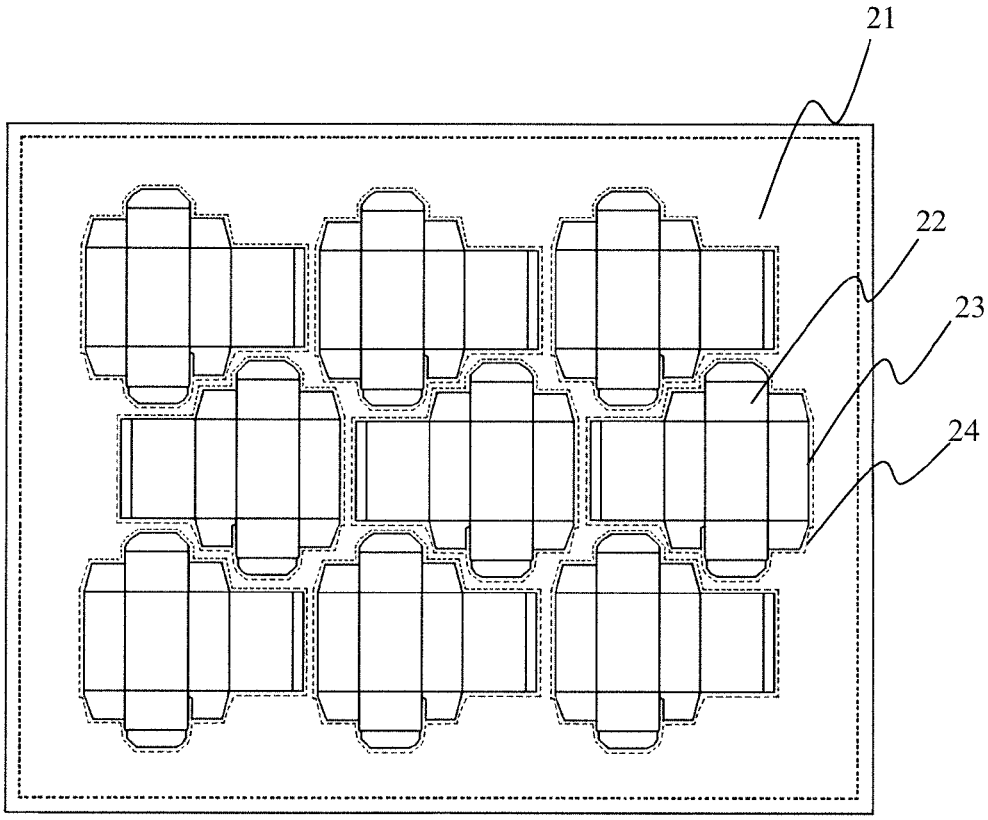
FIG. 2 illustrates the effect of the bleed limit on the packaging layout in an embodiment.

Examples are presented for bleed control for the decoration patterns on the packaging layout with printing marks. FIG. 1 is a flow chart illustrating steps for bleed control in a packaging layout. The flow chart includes setting a bleed width at step S11 in every packaging decoration pattern on a packaging layout and generating bleed lines based on the bleed width. FIG. 2 shows a packaging layout 21 including a number of decoration patterns 22 in an embodiment. The bleed lines include external bleed lines and internal bleed lines. As illustrated in FIG. 2, the external bleed lines 24 extend outward a bleed width from cutting lines 23 (black solid line) of the packaging decoration pattern 22. The external bleed lines 24 are the external contours of the packaging decoration pattern 22. The internal bleed lines (not shown) are obtained from shrinking a bleed width inward from cutting lines that form a window in packaging decoration pattern 22. The specific value of the bleed width may be set by a user according to practical need. In a specific embodiment, the bleed width is set to 3 mm.

Figure 3:
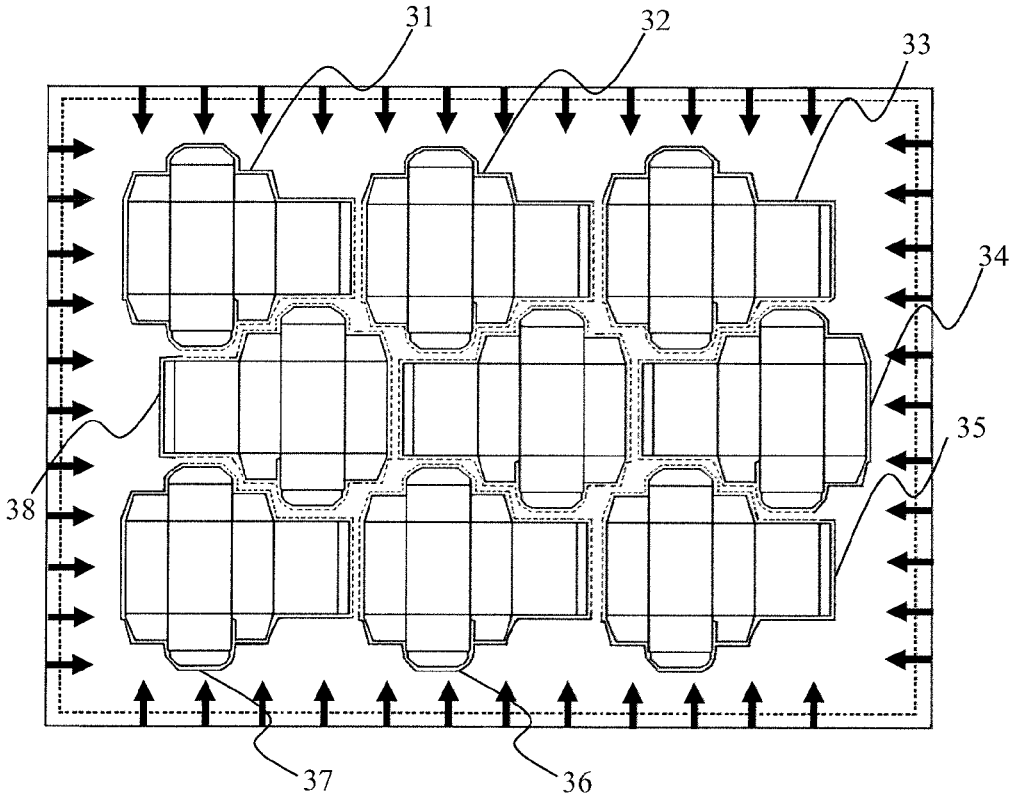
FIG. 3 illustrates the effect of acquiring designated bleed line segments based on a beam projection method in an embodiment.
Figure 4:
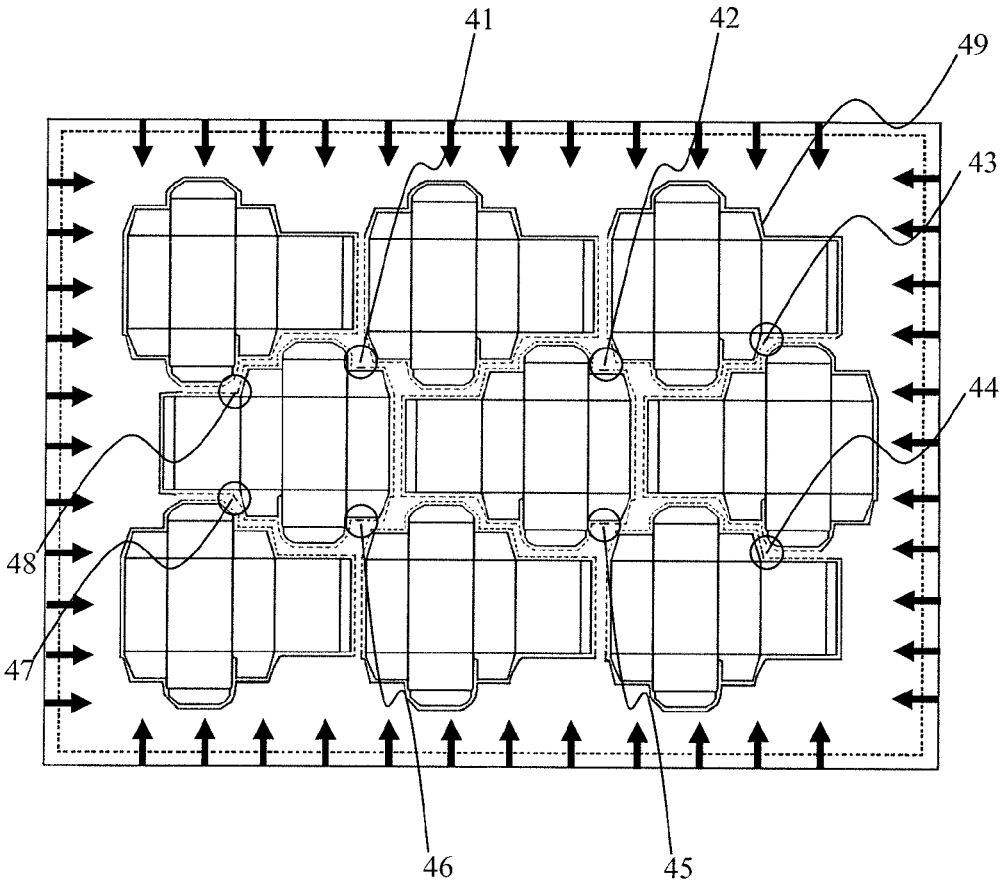
FIG. 4 illustrates the effect of excluding some segments from the designated bleed line segments for releasing bleed limit in an embodiment.

Referring to FIG. 1 again, the flow chart also includes acquiring designated or irradiated bleed line segments by directly irradiating light beams toward the packaging layout at step S12. The light beams come from four directions (as pointed by arrows in FIG. 3, up, down, left, right) and are substantially perpendicular to the packaging layout 21 to acquire designated bleed line segments 31-38 of the decoration patterns 22. As illustrated in FIG. 3, the bleed line segments 31-38 are irradiated by the light beams directly, and are not blocked by other decoration patterns. FIG. 4 also illustrates designated or irradiated bleed line segments 41-48 in circled areas.

The flow chart further includes correcting the irradiated bleed line segments acquired at step S12, and excluding some bleed line segments for releasing bleed limit at step S13. Step S13 includes setting a threshold, and calculating a percentage or ratio based on the projection length of a bleed line segment to the projection length of the bleed line on a packaging decoration pattern in a respective irradiation direction. If the percentage or ratio is less than the threshold, bleed limit is retained for the bleed line segment. If the percentage or ratio is equal or greater than the threshold, bleed limit is released for the bleed line segment at step S14. For example, bleed line segments 41-48 in FIG. 4 are not released or retained for bleed limit.

The threshold value may be determined according to the size of packaging layout. The threshold may vary from 10% to 25%. In a particular embodiment, the threshold value is set to 10%.

There may be a common portion for the bleed line segments in the packaging decoration patterns irradiated by light beams from different directions. For example, the bleed line segment 49 in the upper right corner of FIG. 4, can be simultaneously irradiated by the light beams from up to down, and the light beams from left to right. If this is the case, the two bleed line segments are merged into one bleed line segment, which needs to release bleed limit.

Figure 5:
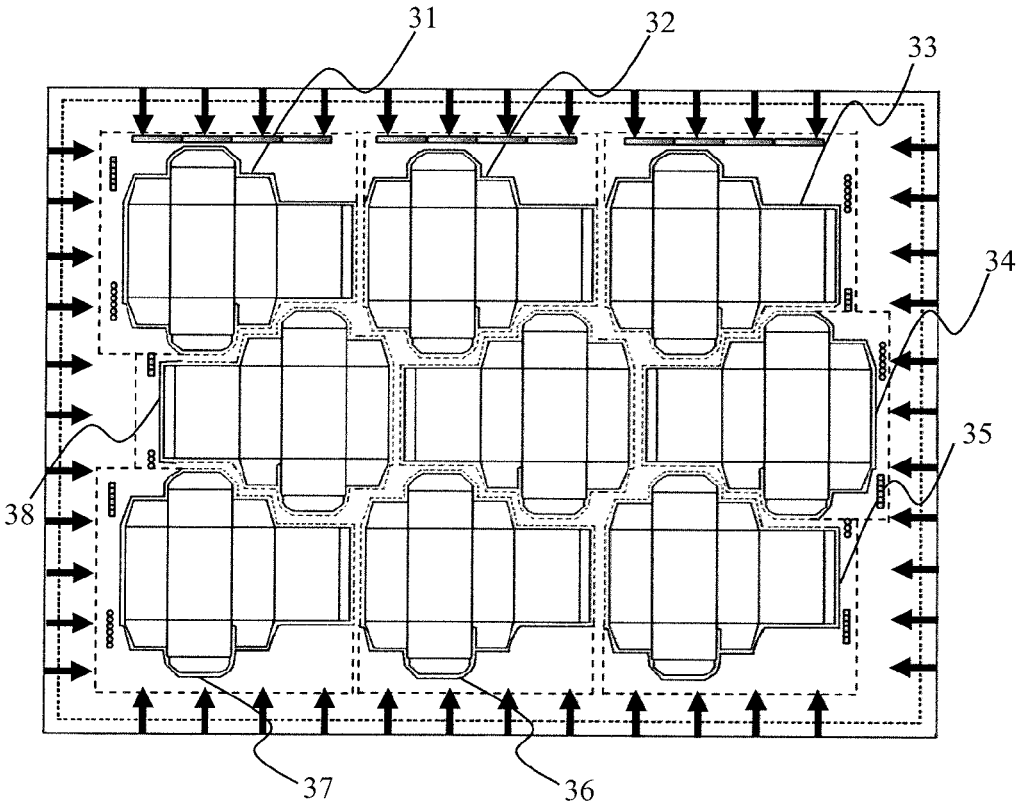
FIG. 5 illustrates the effect after correcting the designated bleed line segments in an embodiment.

The flow chart also includes releasing bleed limit at step S14 for the corrected bleed line segments facing the beam directions. As illustrated in FIG. 5, the corrected bleed line segments after step S13 include bleed line segments 31-38, but exclude bleed line segments 41-48.

Figure 6:
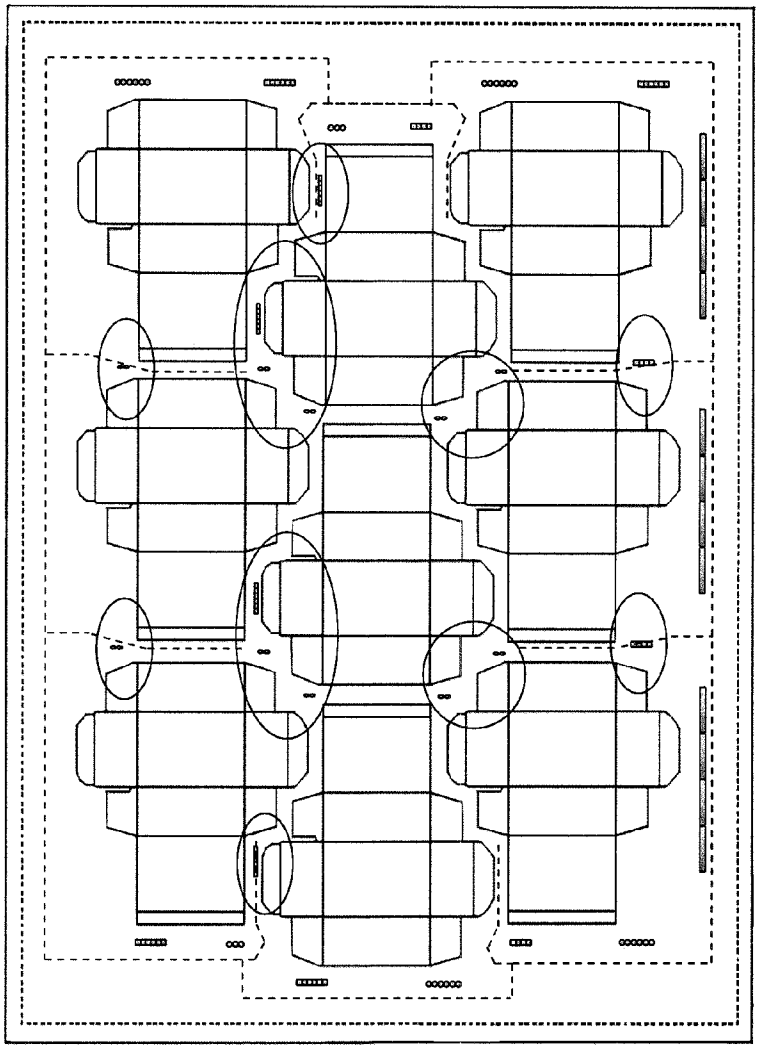
FIG. 6 illustrates the effect of the bleed limit according to existing technologies.
Figure 7:
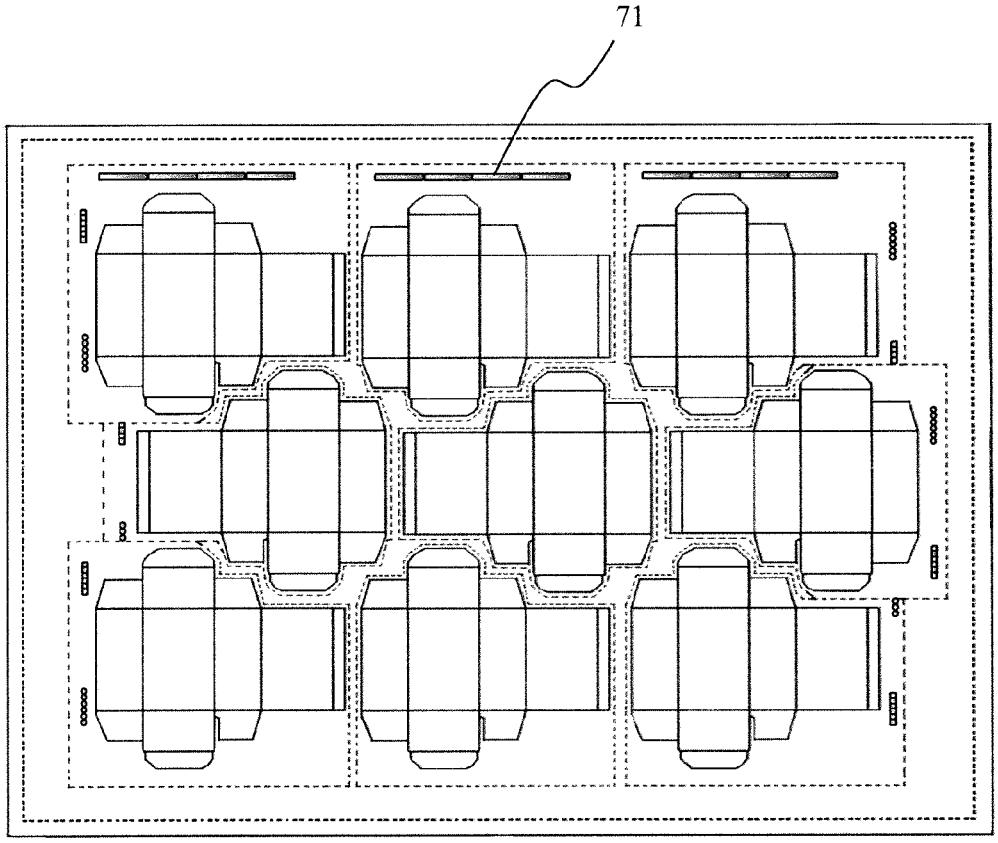
FIG. 7 illustrates the effect of the bleed limit according to the disclosed method in an embodiment.

The effect of using the method provided by the present disclosure to control bleed of packaging decoration patterns in the packaging layout is shown in FIG. 7, compared to the effect of using the existing technologies to control bleed, as shown in FIG. 6.

In the embodiment, if the packaging decoration patterns interfere each other after releasing bleed limit, for example, two adjacent decoration patterns may overlap, a midline cutting method is used to separate the two decoration patterns. The midline is formed by points having equal distances to the external cutting lines of the two decoration patterns. If there are several packaging layouts, steps S11-S14 are repeated for each packaging layout.

The objects for beam projection in step S12 are the bleed lines of the decoration patterns. The objects for irradiation may also be the outer cutting lines of the decoration pattern.

FIG. 7 shows the improved result of the bleed control method of FIG. 1 to retain outside printing marks 71 and to remove inside or internal printing marks (see circled areas in FIG. 6) and to separate two adjacent decoration patterns that interfere (comparing FIG. 6 and FIG. 7) in an embodiment.

This disclosure uses a beam projection method. The beams come from all directions, i.e. up, down, left, right, and project to the packaging layout 21 perpendicularly. Release the bleed limit for the bleed line segments of the packaging decoration pattern, as shown in the figures. To retain the original marks of the packaging decoration patterns (see printing marks 71 in FIG. 7) and save time for re-adding printing marks, bleed limit is released for the bleed line segments 31-38 in FIG. 3 or FIG. 5. To simplify the packaging layout and reduce waste of printing ink for internal printing marks, bleed limit is retained for the bleed line segments 41-48 in FIG. 4 and for the bleed lines that are not irradiated.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

It should thus be noted that the matter contained in the above description or shown in the accompanying drawings should be interpreted as illustrative and not in a limiting sense.

What is claimed is:

1. A method for bleed control on a packaging layout having a plurality of packaging decoration patterns for making a plurality of packaging boxes comprising:

setting a bleed width;

obtaining bleed lines based on the bleed width from cutting lines of each packaging decoration pattern for each packaging box;

irradiating light beams toward the packaging layout in four directions substantially perpendicular to each side of the packaging layout to form irradiated bleed line segments, wherein the packaging layout is substantially rectangular-shaped;

calculating a ratio of the projection length of each of irradiated bleed line segments to a respective projection length of a respective bleed line for each packaging decoration pattern in a respective irradiating direction;

comparing the ratio with a threshold;

excluding the irradiated bleed line segments for releasing bleed limit if the ratio is less than the threshold; and releasing bleed limit for the irradiated bleed line segments facing the four directions if the ratio is equal or greater than the threshold.

2. The method of claim 1, wherein the bleed width is 3 mm.

3. The method of claim 1, wherein the bleed lines comprise external bleed lines extending the bleed width outward from the cutting lines of each package decoration pattern.

4. The method of claim 1, wherein the bleed lines comprise internal bleed lines extending the bleed width inward from the cutting lines of each package decoration pattern.

5. The method of claim 1, further comprising irradiating outer cutting lines in the packaging layout.

6. The method of claim 1, further comprising merging two bleed line segments that have a common portion irradiated by light beams and releasing bleed limit for the merged bleed line segment.

7. The method of claim 1, wherein the threshold ranges from 10% to 25%.

8. The method of claim 1 further comprising separating two neighboring package decoration patterns that interfere with each other through a middle division line cutting method.

9. A system for bleed control on packaging layout, comprising:

a first acquiring module configured to set a bleed width and obtain bleed lines based on the bleed width from cutting lines of each packaging decoration pattern for each packaging box;

a second acquiring module configured to irradiate light beams toward the packaging layout in four directions substantially perpendicular to each side of the packaging layout to form irradiated bleed line segments, wherein the packaging layout is substantially rectangular-shaped;

an excluding module configured to calculate a ratio of the projection length of each irradiated bleed line segment to a respective projection length of a respective bleed line for each packaging decoration pattern in a respective irradiating direction, to compare the ratio with a threshold, and to exclude the irradiated bleed line segments for releasing bleed limit if the ratio is less than the threshold; and a releasing module configured to release bleed limit for the irradiated bleed line segments facing the four directions if the ratio is equal or greater than the threshold.

10. The system of claim 9, wherein the bleed width of bleed line is 3 mm.

11. The system of claim 9, wherein the threshold of bleed line segments ranges from 10% to 25%.

12. A method for printing a layout on a printing material, said layout having a plurality of decoration patterns, said method comprising:

setting a bleed width;

obtaining bleed lines based on the bleed width from cutting lines of each decoration pattern;

irradiating light beams toward the layout in four directions substantially perpendicular to each side of the layout to form irradiated bleed line segments, wherein the layout is substantially rectangular-shaped;

calculating a ratio of the projection length of each of irradiated bleed line segments to a respective projection length of a respective bleed line for each decoration pattern in a respective irradiating direction;

comparing the ratio with a threshold;

excluding the irradiated bleed line segments for releasing bleed limit if the ratio is less than the threshold; and releasing bleed limit for the irradiated bleed line segments facing the four directions if the ratio is equal or greater than the threshold.

* * * * *